US010634339B2

(12) United States Patent
Hennessey et al.

(10) Patent No.: US 10,634,339 B2
(45) Date of Patent: Apr. 28, 2020

(54) ONCE-THROUGH VERTICAL TUBED SUPERCRITICAL EVAPORATOR COIL FOR AN HRSG

(71) Applicant: Nooter/Eriksen, Inc., Fenton, MO (US)

(72) Inventors: James R. Hennessey, Ballwin, MO (US); Shaun P. Hennessey, St. Charles, MO (US); Vladimir S. Polonsky, Ballwin, MO (US)

(73) Assignee: Nooter/Eriksen, Inc., Fenton, MO (US)

( * ) Notice: Subject to any disclaimer, the term of this patent is extended or adjusted under 35 U.S.C. 154(b) by 394 days.

(21) Appl. No.: 15/518,168

(22) PCT Filed: Oct. 9, 2015

(86) PCT No.: PCT/US2015/054927
§ 371 (c)(1),
(2) Date: Apr. 10, 2017

(87) PCT Pub. No.: WO2016/057911
PCT Pub. Date: Apr. 14, 2016

(65) Prior Publication Data

US 2017/0307208 A1 Oct. 26, 2017

Related U.S. Application Data

(60) Provisional application No. 62/062,055, filed on Oct. 9, 2014.

(51) Int. Cl.
*F28F 9/22* (2006.01)
*F22B 1/18* (2006.01)
(Continued)

(52) U.S. Cl.
CPC ..... *F22B 1/1815* (2013.01); *F01K 7/30* (2013.01); *F01K 7/32* (2013.01); *F22B 29/067* (2013.01);
(Continued)

(58) Field of Classification Search
CPC ..... F22B 1/1815
See application file for complete search history.

(56) References Cited

U.S. PATENT DOCUMENTS 1,906,125 A * 4/1933 Kerr ..... F22G 7/14 122/478
1,961,233 A * 6/1934 Mayr ..... F22B 29/08 122/235.12
(Continued)

FOREIGN PATENT DOCUMENTS

CN 1145754 C 4/2004
CN 101684937 A 3/2010
(Continued)

OTHER PUBLICATIONS

Office Action for corresponding Japanese Patent Application No. 2017-518887 dated May 17, 2019.
(Continued)

*Primary Examiner* — Nathaniel Herzfeld
(74) *Attorney, Agent, or Firm* — Sandberg Phoenix and von Gontard

(57) ABSTRACT

Disclosed is a Once-Through Steam Generator (OTSG) coil (52) and method, comprising a plurality of vertically arranged serpentine conduits (90) in a horizontal heat recovery steam generator (HRSG) that replaces a traditional natural circulation HP evaporator for producing supercritical steam. The OTSG comprises a lower equalization header system (130) that promotes system stability in multiple operating conditions. The equalization header allows a partial flow of fluid from the lower serpentine curved flow path (120) through an equalization conduit (125) into the equalization header (130) Disclosed also are: a flow restriction device in serpentine conduits; drainage structure from serpentine conduits through the equalization header, a drainage expansion section to accommodate stresses, and drainage
(Continued)

bypass connections; and flow through serpentine conduits in upstream and downstream directions, mixed flow directions and longitudinally staggered directions.

37 Claims, 8 Drawing Sheets

(51) Int. Cl.

| | |
|---|---|
| ***F28D 21/00*** | (2006.01) |
| ***F22B 29/06*** | (2006.01) |
| ***F01K 7/30*** | (2006.01) |
| ***F01K 7/32*** | (2006.01) |
| ***F22D 1/32*** | (2006.01) |
| ***F28D 7/08*** | (2006.01) |
| *F01K 7/16* | (2006.01) |

(52) U.S. Cl.
CPC ..... *F22D 1/32* (2013.01); *F28D 7/085* (2013.01); *F28D 21/0003* (2013.01); *F28F 9/22* (2013.01); *F01K 7/16* (2013.01); *F22B 1/18* (2013.01)

(56) References Cited

U.S. PATENT DOCUMENTS

| | | | | | |
|---|---|---|---|---|---|
| 2,221,871 | A * | 11/1940 | Kerr | F22G 7/14 | 122/478 |
| 2,423,997 | A * | 7/1947 | Ruegg | F24H 3/087 | 126/109 |
| 3,033,535 | A * | 5/1962 | Schaap | F22B 37/141 | 165/171 |
| 4,387,668 | A * | 6/1983 | Kochey, Jr. | F22B 29/065 | 122/235.12 |
| 5,247,991 | A * | 9/1993 | Polcer | F28D 7/06 | 165/145 |
| 6,019,070 | A | 2/2000 | Duffy | | |
| 6,173,679 | B1 * | 1/2001 | Bruckner | F22B 1/1815 | 122/406.4 |
| 6,189,491 | B1 | 2/2001 | Wittchow et al. | | |
| 6,237,542 | B1 * | 5/2001 | Nakajo | F22B 1/1815 | 122/420 |
| 6,508,206 | B1 | 1/2003 | Rechtman | | |
| 8,959,917 | B2 | 2/2015 | Berndt et al. | | |
| 2006/0075977 | A1 | 4/2006 | Franke et al. | | |
| 2009/0241859 | A1 | 10/2009 | Bairley et al. | | |
| 2012/0272649 | A1 | 11/2012 | Berndt et al. | | |
| 2012/0312019 | A1 | 12/2012 | Rechtman | | |
| 2013/0048245 | A1 * | 2/2013 | Schroeder | F22B 21/12 | 165/71 |
| 2013/0180228 | A1 | 7/2013 | Zhang | | |
| 2013/0180696 | A1 | 7/2013 | Magee et al. | | |

FOREIGN PATENT DOCUMENTS

| | | | |
|---|---|---|---|
| DE | 0425717 | A1 | 5/1991 |
| JP | 2000028101 | A | 1/2000 |
| JP | 2001065801 | A | 3/2001 |
| JP | 2003090509 | A | 3/2003 |
| WO | 99/51916 | A1 | 10/1999 |
| WO | 2011/146333 | A2 | 11/2011 |

OTHER PUBLICATIONS

Extended European Search Report of corresponding European Application No. 15848836.1 dated Jun. 18, 2018.
Exhibit 1 Russian Textbook, p. 58 in Russian with English Translation as explained in Affidavit of Yuri M. Rechtman, P.E.
English Translation of Exhibit 1 Russian Textbook p. 58, as explained in Affidavit of Yuri M. Rechtman, P.E.
Affidavit of Yuri M. Rechtman, P.E., re Translation of Russian Textbook p. 58 for this Information Disclosure Statement, and executed Nov. 15, 2017.
Written Opinion of the International Searching Authority of corresponding application No. PCT/US2015/054927 dated Jan. 12, 2016.
International Search Report of corresponding application No. PCT/US2015/054927 dated Jan. 12, 2016.
Office Action for corresponding China Patent Application No. 201580062691.0 dated Aug. 28, 2018.

* cited by examiner

ONCE-THROUGH VERTICAL TUBED SUPERCRITICAL EVAPORATOR COIL FOR AN HRSG

CROSS-REFERENCE TO RELATED APPLICATIONS

The present application is the US National Stage under 35 U.S.C. § 371 of International App. No. PCT/US2015/054927 which was filed Oct. 9, 2015, and which claims priority to U.S. Provisional Patent Application Ser. No. 62/062,055 filed on Oct. 9, 2014, the contents both of which are expressly incorporated herein by reference.

BACKGROUND OF THE INVENTION

Natural gas and fuel oil serve as the energy source for much of the currently generated electricity. To this end, the gas or fuel oil undergoes combustion in a turbine which powers an electrical generator. The products of combustion leave the turbine as an exhaust gas quite high in temperature so that the exhaust gas represents an energy source in itself. This energy is captured in a heat recovery steam generator ("HRSG") that produces superheated steam that powers another electrical generator.

Generally, an HRSG comprises a casing having an inlet and an outlet and a succession of heat exchangers—that can include a superheater, an evaporator, and an economizer arranged in that order within the casing between the inlet and outlet.

Such heat exchangers for an HRSG can have multiple banks of coils, the last of which in the direction of the gas flow can be a feedwater heater. The feedwater heater receives condensate that is derived from low-pressure steam discharged by the steam turbine, and elevates the temperature of the water. Then the warmer water from the feedwater heater flows for example into one or more economizers, boiler feed pumps or evaporators, which convert it into saturated steam. That saturated steam flows on to a superheater which converts it into superheated steam. From such a superheater, the superheated steam can flow to the steam turbine.

Generally, in the above-discussed process, most HRSGs produce superheated steam at three pressure levels—low pressure (LP), intermediate pressure (IP) and high pressure (HP). An HRSG can thus have one or more superheaters and also can have what are termed an LP Evaporator, an HP Economizer, and an IP Economizer.

An overall illustration of a system which features an HRSG using a natural circulation system appears in U.S. Pat. No. 6,508,206 B1 (hereafter "'206 Patent"), which '206 Patent is incorporated by reference. FIG. 4 of the '206 Patent illustrates an arrangement with a superheater 18 located at the farthest position upstream. Downstream from the superheater 16 in the internal HRSG flow path is at least one evaporator 18 which has in fluid flow connection therewith a steam drum shown located atop of the evaporator. That steam drum is located outside of the HRSG internal exhaust gas flow path. The HRSG in the '206 Patent also has a feedwater heater 20.

The superheated steam produced by an HRSG has typically been below the critical point pressure of steam. Industry trends to build power plants of larger scale and of greater efficiency have evolved into a need for such plants to operate above, or just below, the critical pressure of water.

In a natural circulation HRSG, water is first evaporated into saturated steam. This takes place in the high pressure (HP) evaporator coil and drum combination, which is simply referred to herein as "HP evaporator section" (HPEVAP). In such an HP evaporator coil and drum combination, the evaporator coil is located within the internal exhaust flow path of the HRSG, while the drum is located exterior to the internal exhaust flow path of the HRSG, with the HP evaporator coil and drum being in fluid flow connection with one another. In the HPEVAP, the density difference of steam and water at saturation conditions is the driving force to cause water and/or steam to circulate from a steam drum through downcomer pipes to the HPEVAP coil tubes, and through risers back to the steam drum. This circulation of saturated water in the HPEVAP is what distinguishes a natural circulation HRSG from other types of HRSGs.

Another type of HRSG is a system that uses a once-through steam generator, commonly referred to in the art as an "OTSG". In an OTSG, the working fluid does not recirculate through the heating surface as with a natural circulation HRSG system. Rather, with an OTSG the working fluid makes one pass through each individual parallel HPEVAP conduit and then exits the OTSG. U.S. Pat. No. 6,019,070 to Duffy ("Duffy '070' Patent") discloses an HRSG having an OTSG with what are designated therein as circuit assemblies. Those circuit assemblies in the Duffy '070 Patent each comprises a serpentine shaped heat exchange tube with U-bend shaped portions and vertically oriented linear portions, positioned within the HRSG internal gas flow path.

U.S. Pat. No. 6,189,491 to Wittchow, et al. ("Wittchow '491 Patent") also discloses an HRSG having an OTSG with vertically disposed steam-generator tubes within the HRSG gas flow path. U.S. Pat. No. 8,959,917 to Berndt, et al. ("Berndt '917 Patent") discloses an HRSG that uses an OTSG, while U.S. Patent Application Zhang having Pub. No. US 2013/0180228 A1, discloses an HRSG with a supercritical evaporator arrangement ("Zhang '228 Applic.") The said Duffy '070 Patent, Wittchow '491 Patent, Berndt '917 Patent and Zhang '228 Applic. are incorporated herein as if fully set forth herein.

FIG. 1 of the present application shows an overall layout of a system that illustrates use of an HRSG similar to that shown in FIG. 3 of the '206 Patent. FIG. 1 of the present application discloses a gas turbine G that discharges hot exhaust gases into an "HRSG", which extracts heat from the gases to produce steam to power a steam turbine S. The gas turbine G and steam turbine S power the generators E that are capable of producing electrical energy. The steam turbine S discharges steam at a low temperature and pressure into a condenser CN, where it is condensed into liquid water. The condenser CN is in flow connection with a condensate pump CP that directs the water back to the HRSG as feedwater.

Generally, the heat exchangers comprise coils that have a multitude of tubes that usually are oriented vertically and arranged one after the other transversely across the interior of the casing. The coils are also arranged in rows located one after the other in the direction of the hot gas flow depicted by the arrows in FIGS. 2-7 of the present application. The tubes contain water in whatever phase its coils are designed to accommodate. The length of the tubes can be as great as about 90' tall.

SUMMARY OF DISCLOSURES

As discussed above, in order to maximize cycle efficiency, an HRSG generally contains multiple pressure levels of superheated steam generation and steam reheat. The current invention will allow the operating pressure range to be increased to include steam production at supercritical pressures. Since only one pressure system (for a given working fluid), and nominally the high pressure (HP) system, can run at supercritical pressure, it is desirable to maintain natural circulation for the other pressure levels, typically the intermediate pressure (IP) and low pressure (LP) systems. There can be other pressure systems and nomenclature. This summary does not limit the type of HRSG that can be used.

At pressures approaching the critical point of water, the density difference of water and steam at saturation conditions is much less than it is at lower pressures. Under such conditions, the hydrodynamics that drive the flow in a natural circulation evaporator are diminished to the point where another method is required to ultimately generate flow for the plant generation needs. In this case, it is practical to design and operate the HPEVAP as a once through steam generator (OTSG) in which, as noted, the working fluid does not recirculate through the heating surface but rather makes one pass through each individual parallel HPEVAP tube conduit and then exits the HPEVAP section. The OTSG as shown in FIG. 2 replaces the typical HPEVAP in a natural circulation HRSG. Though OTSG's are known in the HRSG art, there is a need for the production of sub-critical and supercritical steam by means employed in using an OTSG to handle the operating conditions in a stable and mechanically acceptable design. The stratification of two-phase flows, critical heat fluxes, and instability are major concerns for designers of OTSGs. In supercritical conditions the working fluid exists as a single phase fluid and is sensibly heated as it passes through the parallel circuits of the HPEVAP.

In the present disclosures, the OTSG is configured to comprise a group of individual serpentine tubes having vertical tube sections, and bends toward the top and bottom that are in flow connection with the vertical tube sections. Water can be introduced into the inlet of the OTSG group of tubes from the exit of the HP Economizer via pressure from the HP Feedwater Pump. The water can then be heated as it moves through the serpentine tubes in the OTSG coil, absorbing heat from the exhaust gas. At pressures slightly lower than the critical point the fluid exits as two phase or slightly superheated steam. At pressures at or above the critical point, the fluid exits the OTSG having properties consistent with the temperature. The OTSG operates under a high mass flux. As with other HRSGs, the supercritical water/steam fluid exiting the evaporator coil can be heated further in coil sections upstream in the gas path, absorbing heat from even higher temperature gas and increasing the temperature further to maximize the steam cycle efficiency.

Accommodation of pressure differences that may exist between the individual conduits that contain serpentine tubes, is provided by an inter-association among those conduits to assist in balancing the pressure. Such equalization promotes pressure stability among the tube circuits. The configuration and location of the inter-association conduits utilize natural forces to aid in separating liquid from steam in the process, to promote two phase separation below the lower U-bends of the individual serpentine conduit sections. This assists in directing water into the equalization conduits, which promotes flow stability. More particularly, the disclosure preferably provides headers interconnected among the individual conduits. The headers are preferably positioned beneath the bottom of the lower U-bends of the serpentine tubes transverse to the internal exhaust gas flow. Further, the disclosure preferably includes a flow restriction device in flow connection with individual serpentine tubes positioned to improve flow distribution and flow stability, and preferably located toward the inlet of the serpentine tube. Moreover, the disclosure preferably provides drainage from the serpentine tube.

DETAILED DESCRIPTION OF EMBODIMENTS

Figure 1:
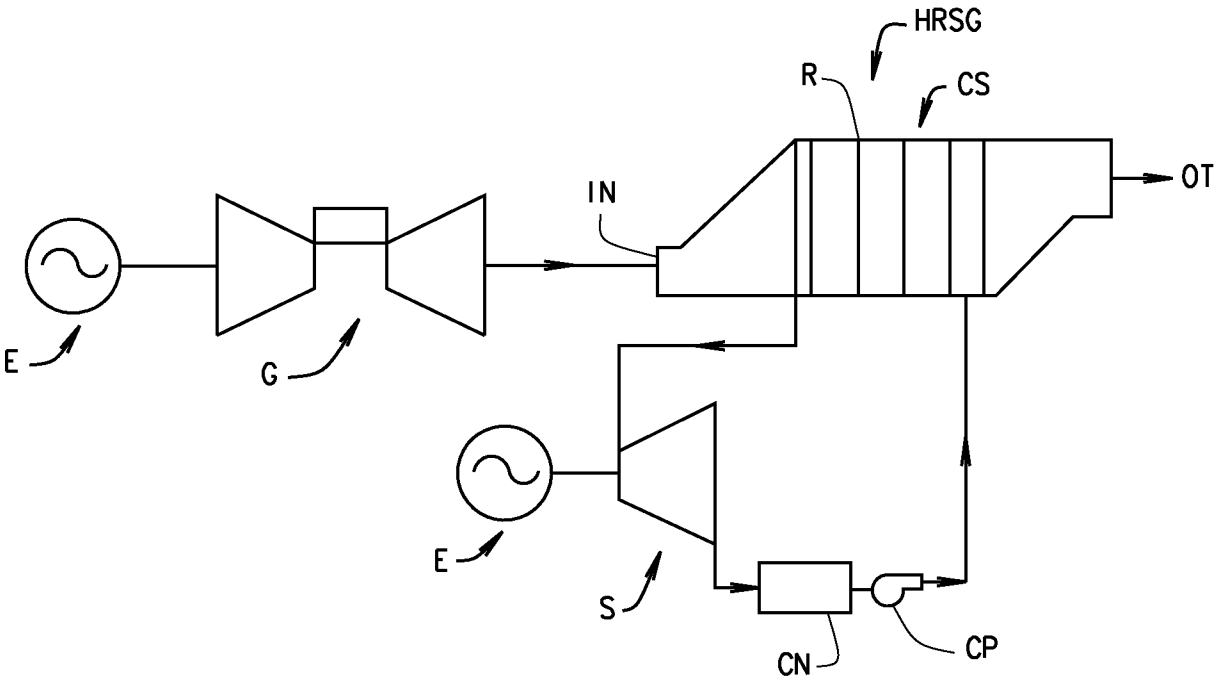
FIG. 1 is a general schematic of a combined cycle power system having an HRSG, that can use the present invention.

The following detailed description illustrates the claimed invention by way of example and not by way of limitation. The description clearly enables one skilled in the art to make and use the disclosure, describes several embodiments, adaptations, variations, alternatives, and uses of the disclosure, including what is presently believed to be the best mode of carrying out the claimed invention. Additionally, it is to be understood that the disclosure is not limited in its application to the details of construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

For the following description, we will refer to the supercritical water/steam mixture and the sub-critical water/steam mixture as "fluid". This should not infer that the behavior of sub-critical water and steam are the same as supercritical water/steam.

Figure 2:
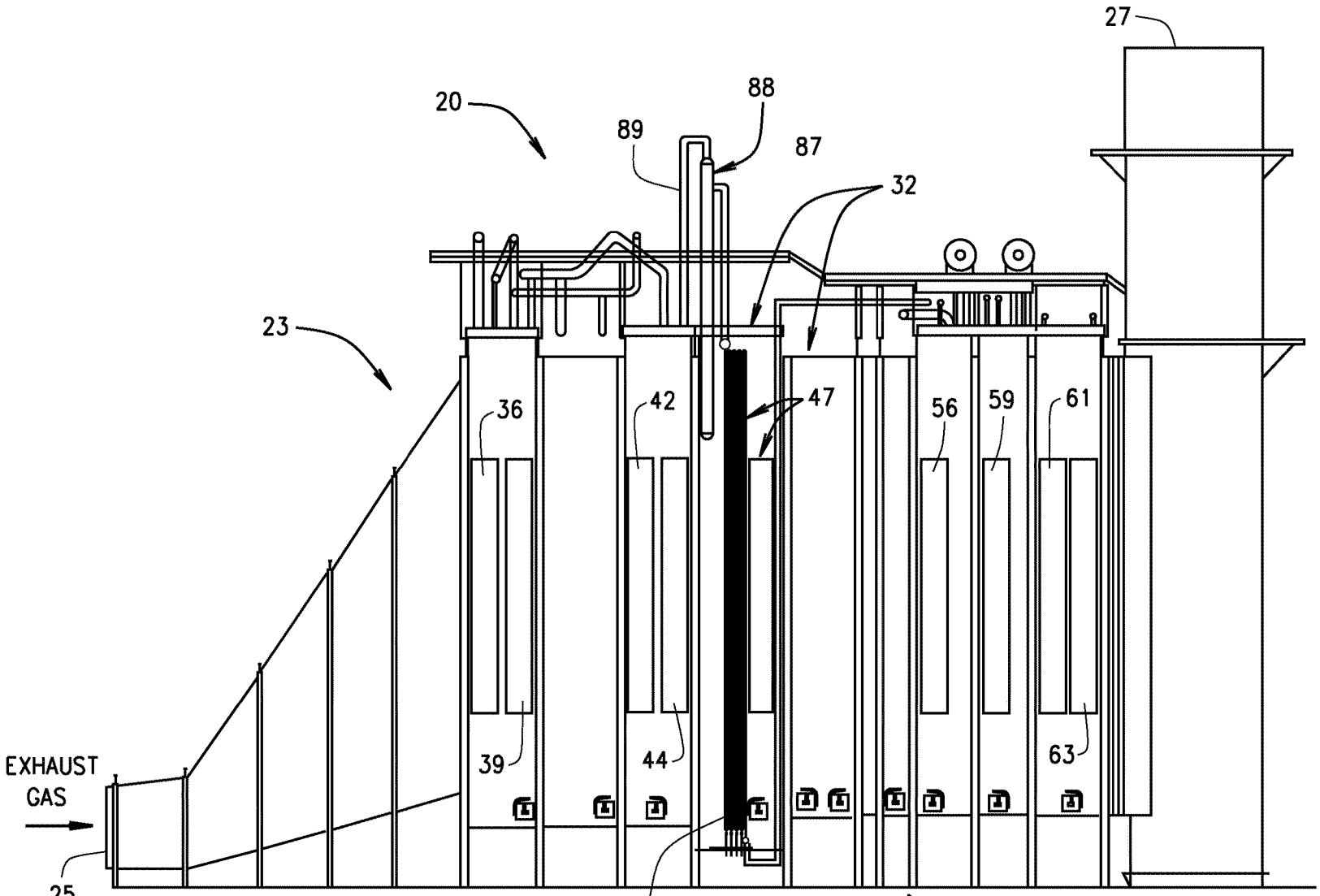
FIG. 2 is a sectional view of an embodiment with an HRSG, and illustrating a once-through vertical tubed supercritical evaporator coil.

Referring to FIG. 2, an HRSG 20 has a casing 23 within which are heat exchangers. Hot exhaust gases, such as discharged from a gas turbine (e.g., turbine G of FIG. 1), enter the casing 23 and pass through a duct having an inlet 25 and an outlet 27, such as indicated by arrows in FIGS. 1 and 2. During such process, that gas passes through heat exchangers.

The HRSG casing 23 has a floor 30, a roof 32, and sidewalls that extend upwardly from the floor 30 to the roof 32. The heat exchangers are positioned within the casing 23. The floor 30 and roof 32 extend between the sidewalls so that the floor 30, sidewalls and roof 32 help to form the internal duct of the HRSG casing 23, through which the exhaust gas passes.

FIG. 2 shows an HRSG casing with an exemplary sequential arrangement of heat exchangers. In FIG. 2, in a longitudinal direction from left to right, in the direction of the arrow showing exhaust gas flow, are a first reheater 36, followed by a first high pressure (HP) superheater 39, then downstream therefrom a second HP superheater 42 followed by a second reheater 44.

In the interest of minimizing the disruption to a "typical" horizontal gas flow, the disclosed vertical tube once-through HP evaporator (OTSG) 47 is shown in FIG. 2 in a preferred position. As such, it replaces a natural circulation HPEVAP in an HRSG. For maintaining the balance of the HRSG as normally supplied, a horizontal gas path is preferable.

Figure 3:
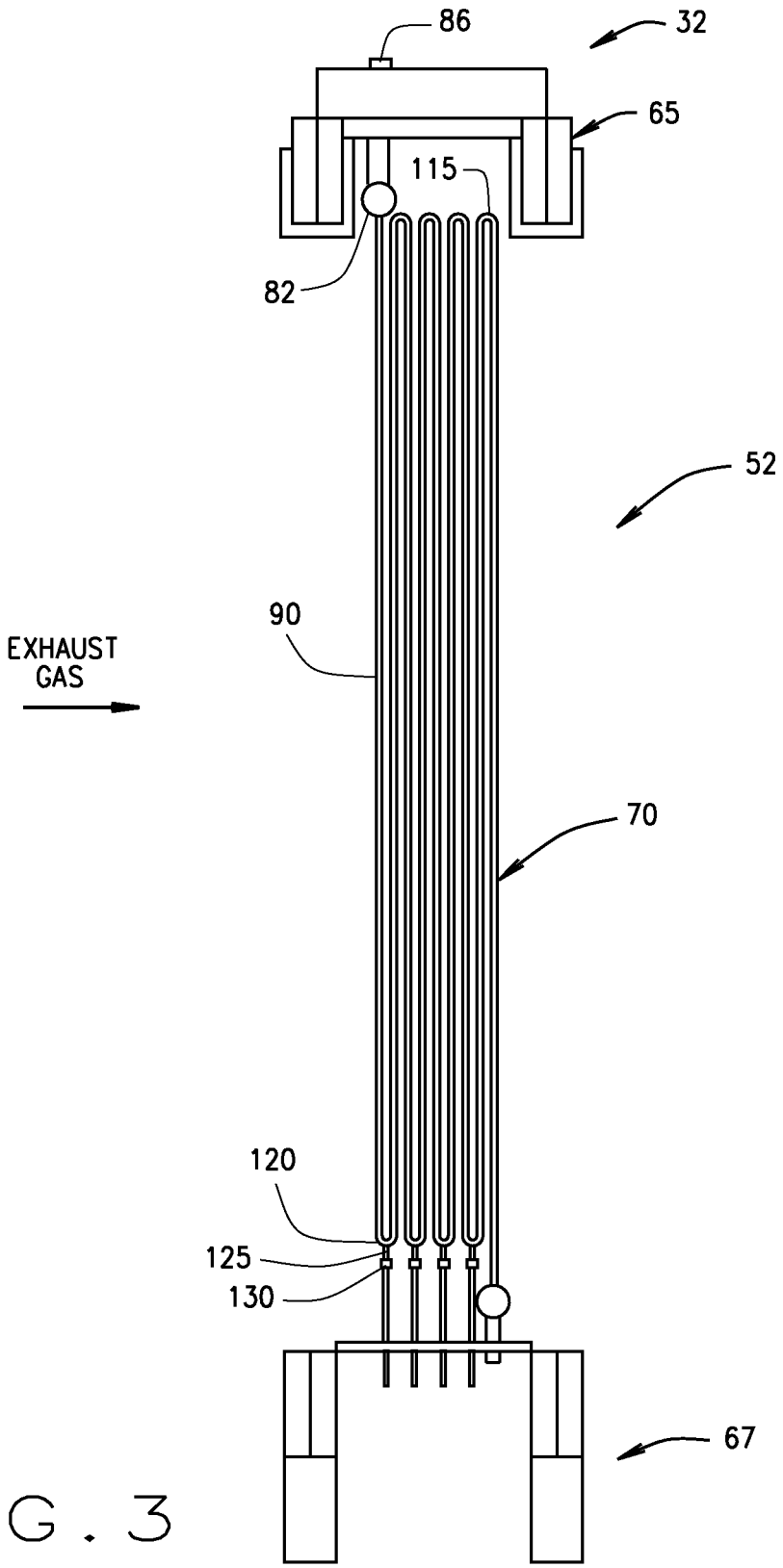
FIG. 3 is a sectional view of a first embodiment of the invention showing part of the floor and roof of an HRSG, shown in a representative scale of height to width.

The OTSG 47 comprises a large coil 52, shown in FIG. 3. Coil 52 comprises individual serpentine tubes assembled into a module of convenient size for transportation, and will be further described. Downstream from the OTSG 47 can be a high pressure (HP) economizer system 56, followed downstream by an intermediate pressure (IP) system 59, which can be then followed by a low pressure (LP) system 61. Downstream therefrom can be a feedwater heater system 63 (e.g., such as discussed and disclosed in the '206 Patent).

The coil 52 is supported from its roof structure 42 hanging in a steel frame, shown partially in FIG. 3 as the roof beams 65 and floor beams 67. The exhaust gas is contained inside the steel frame by an insulated casing and liner system typically found in HRSG's and partially shown in FIG. 2 as the roof 32 and floor 30.

Figure 4:
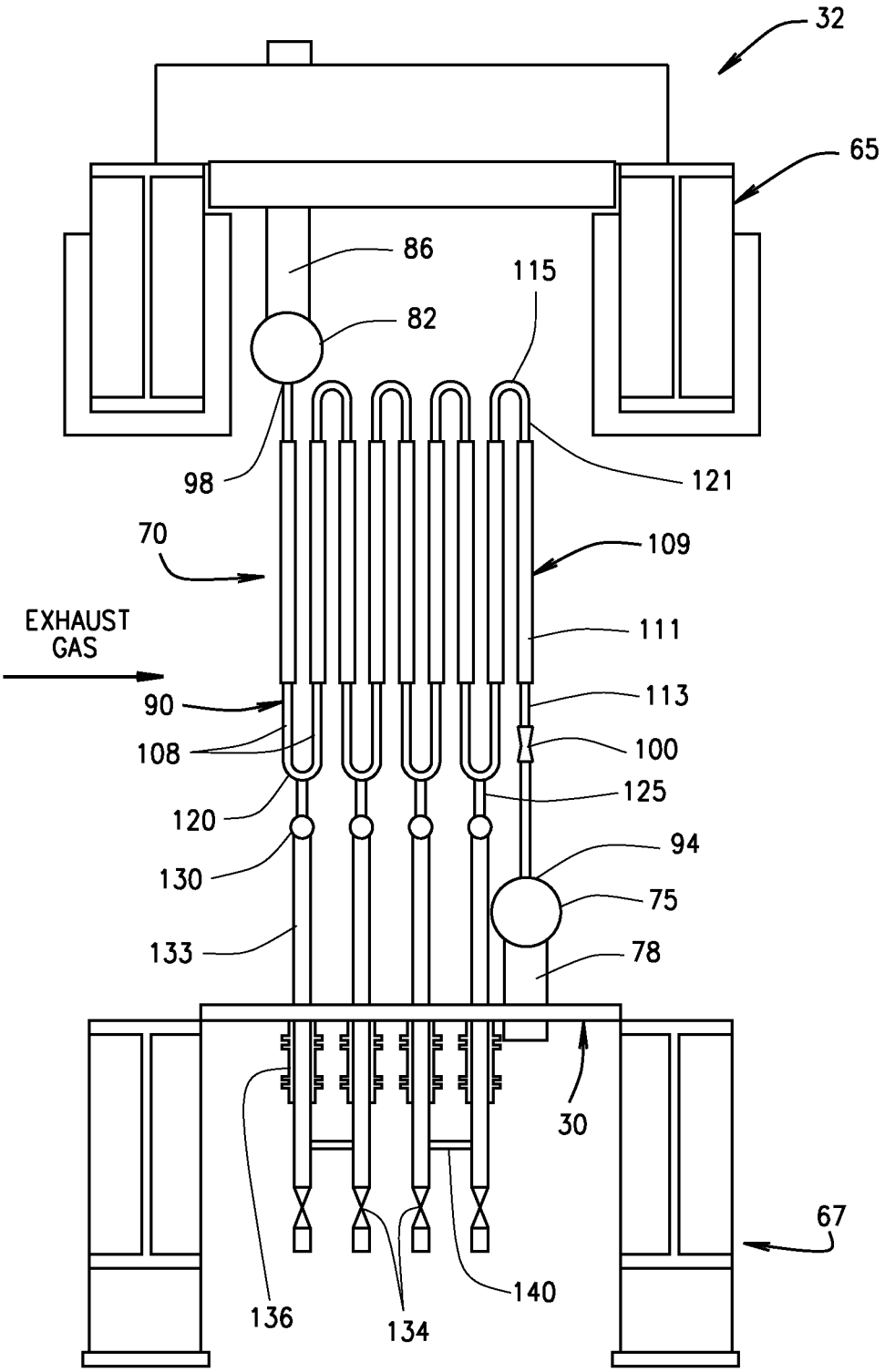
FIG. 4 is the preferred embodiment of the invention, showing an inlet at the bottom and an odd number of tube rows.

Turning now from the FIG. 2 description to a more detailed discussion of the OTSG 47 and its coil 52, the coil 52 comprises a plurality of individual heat exchange conduits illustrated as tubes 90. FIG. 3 shows a sub-group 70 of tubes 90, with the number of individual tube conduits reduced for purposes of illustration. FIG. 4 shows an even more detailed elevation view of a subgroup 70.

Referring to FIG. 4, in general, the OTSG 47 has an inlet header 75, which can be a pipe, that can receive fluid from an inlet conduit 78 that is connected to the outlet of the HP Economizer 56 (depicted in FIG. 2). The OTSG 47 also has an outlet header 82 that is in fluid flow connection with an outlet conduit 86. Conduit 86 can lead to fluid flow connection with the inlet 87 of an external separator 88, the outlet 89 of which can lead to flow connection with the inlet of the HP Superheater 44 (depicted in FIG. 2).

Figure 5:
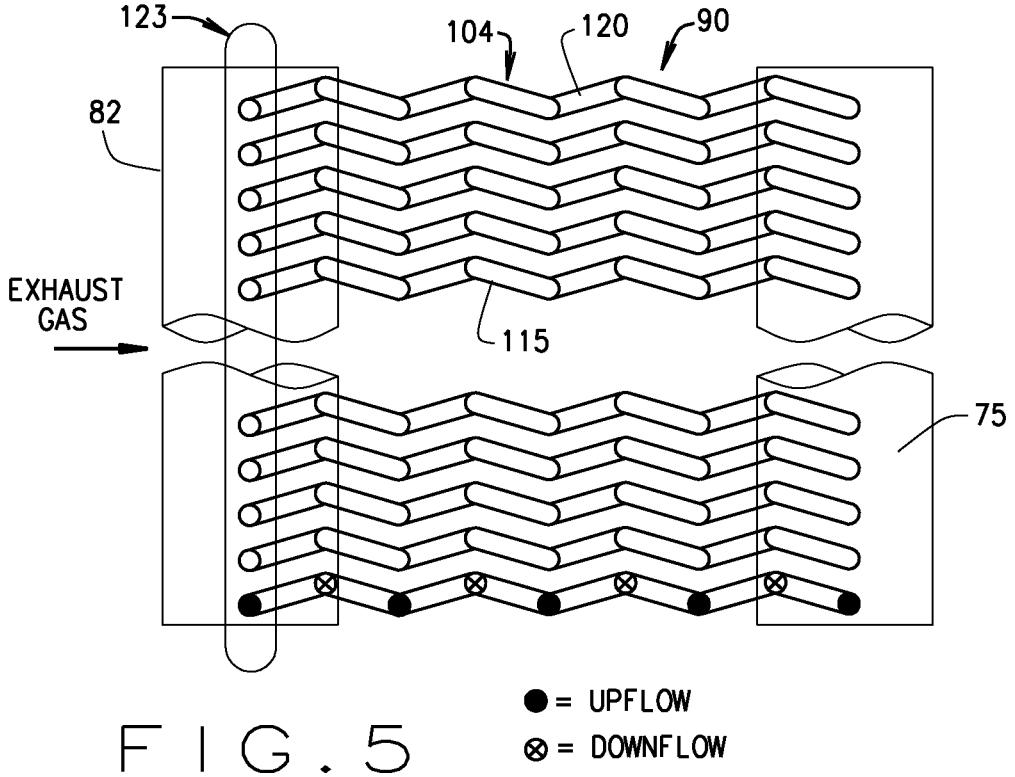
FIG. 5 is a plan view of a preferred first embodiment of the invention in a staggered tube pitch arrangement, with an oblong bubble (123) toward the left end indicating the ends of one row of vertical sections of a group of individual conduits tube sections; The diagram beneath the drawing indicates that a darkened circular area represents upward flow through a vertical tube section 108 of an individual conduit, while an "x" illustrates downward flow through an adjacent vertical tube section 108, in alternating fashion.

Located between the inlet header 75 and outlet header 82 are a group of individual heat exchange conduits 90. The elevation view of FIG. 4 shows one such conduit 90. The top plan view of FIG. 5 shows that the conduit sub-group 70 comprises a plurality of such individual conduits 90 that are shown in elevation in FIG. 4.

Each individual conduit 90 can be a tube that has an inlet end 94 and an outlet end 98. The inlet header 75 and outlet header 82 are preferably cylindrical bodies arranged normal to the exhaust gas flow, with openings along their lengths to which the inlet ends 94 and outlet ends 98 of tubes 90 are respectively secured, such as by welding.

As shown in FIG. 4, from the inlet conduit end 94, the conduit 90 can preferably comprise a flow restriction device 100 through which fluid flows. The pressure drop associated with the flow restriction device 100 improves flow distribution and flow stability. From flow restriction device 100, the conduit 90 generally extends into a serpentine tube section 104 (FIGS. 4 and 5). Serpentine tube section 104 generally comprises a series of vertical tube sections 108, which comprise a middle portion 109. As known in the art, those vertical sections 108 can comprise a portion 111 having heat exchange fins (which portions 111 are shown enlarged in FIG. 4), and portion 113 which have no fins. The finned portion 111 is illustrated as overlapping the middle portion 109.

The conduits 90 also have a series of non-linear sections which are curved or bent, such as illustrated as a plurality of upper U-bend sections 115 and lower U-bend sections 120. The first of the vertical sections 108 of conduit 90 is designated 121 in FIG. 4. The flow restriction device 100 is incorporated into the flow path of the first sections 121, preferably before flow passes into the middle portion 109 of section 121.

Thus, in the preferred embodiment, flow within an individual conduit 90 comprises upward flow through a vertical tube section 108 to an upper U-bend section 115, and then subsequent downward flow through an adjacent vertical tube section 108 to a lower U-bend section 120. At the last of the series of vertical tube sections 108, fluid flows upwardly through conduit outlet end 98 into outlet header 82. Thus the flow through a conduit 90 is a continuing circuit of alternating upward and downward paths until flow through outlet end 98 reaches the outlet header 82.

As seen in the plan view of FIG. 5, in the subgroup 70 a number of individual conduits 90 are arranged in parallel in general alignment with the internal longitudinal exhaust gas flow path. Vertical tube sections 108 are aligned in a transverse plane that is generally perpendicular to the longitudinal exhaust flow path, to make up "rows" 123 of tube sections 108. Rows 123 are thus arranged normal to the path of the hot exhaust gas. FIG. 5 illustrates the direction of upward fluid flow and downward flow through an exemplary conduit 90 located at the bottom of FIG. 5. As noted in the description of FIG. 5, a darkened circular area designates upward flow through a vertical tube section 108, while an "x" illustrates downward fluid flow through a tube section 108.

In the FIG. 5 preferred embodiment, the vertical tube sections 108 illustrated in FIG. 4 are arranged in a staggered fashion, where each tube section 108 in the tube row 123 is positioned at the midpoint of the transverse spacing of the upstream and/or downstream tube row. The tube sections 108 are thus staggered in a longitudinal direction in the exhaust flow path in an alternate offset pattern. In this arrangement a vertical section longitudinally downstream from an adjacent vertical section is longitudinally offset therefrom in an alternating pattern so that the vertical sections are not in longitudinal alignment In the particular embodiment of FIG. 5, a first group of the vertical sections 108 are in longitudinal alignment with one another, and a second group of the vertical sections 108, are in longitudinal alignment with one another, so that the first and second groups are themselves offset relative to each other longitudinally. Such offset and staggered arrangement is known in the art as "staggered pitch."

Figure 6:
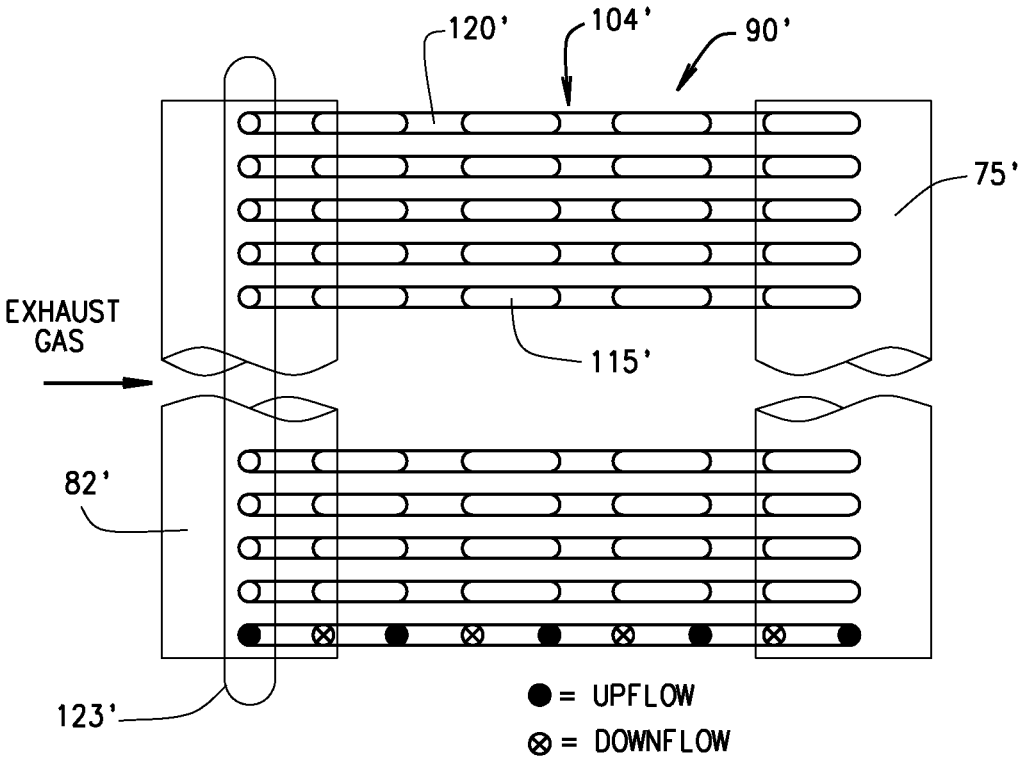
FIG. 6 is a plan view of an alternate embodiment of the invention showing an in-line tube pitch arrangement for the individual conduits, with an oblong bubble (123) toward the left end indicating the ends of one row of vertical sections of a group of individual conduits tube sections; as with FIG. 5; the diagram beneath the drawing indicates that a darkened circular area represents upward flow through a vertical tube section 108' of an individual conduit 90', while an "x" illustrates downward flow through an adjacent vertical tube section 108', in alternating fashion.

FIG. 6 shows an alternate embodiment of the serpentine arrangement, wherein the vertical tube sections 108' are arranged in an in-line pitch, so that the tube sections 108', upper U-bends 115' and lower U-bends 120' in each individual conduit 90' are longitudinally aligned from front to rear of each conduit 90'. Such alignment is known in the art as "in-line pitch."

Referring to FIG. 4, the flow restriction device 100 can be in the nature of an orifice or constricted tube. The orifice is sized based upon the required pressure drop and flow rates. A device 100 is preferably placed in the first tube section 121 section of the first tube row 123 downstream of the inlet header 75 as shown in FIG. 4. The location of the flow restriction device 100 is preferably between the inlet header 75 and the finned portion 111 of the first tube section 121. The pressure drop associated with the flow restriction device improves flow distribution and flow stability.

Now attention is directed toward an arrangement for equalization among the individual conduits 90. Toward the bottom of each lower U-bend section 120 is an intermediate equalization conduit 125. Intermediate conduit 125 can be a relatively short piece of pipe or tube, which has its upper inlet end connected toward the bottom of U-bend section 120, preferably in the middle thereof. Intermediate conduit 125 allows fluid flow from the bottom center of each lower U-bend 120 to flow into an equalization conduit in the form of a header 130. Each equalization header 130 is preferably a cylindrical pipe oriented normal to the exhaust gas flow of the HRSG, and spans the width of one tube row 123 within one coil 52. The outlet ends of intermediate conduits 125 are connected to the header equalization conduits 130 preferably toward the top thereof. Preferably the connection of the outlet end of intermediate conduit 125 to the header conduit 130 is generally directly beneath the connection of the inlet end of intermediate conduit 125 to its respective lower U-bend 120.

As shown In FIG. 4, each equalization header 130 is connected at its underside to a drain 133, such as a pipe, to be in fluid flow connection therewith. The drain pipes 133 extend through the casing floor 30. A bellows expansion joint 136 is connected with drain 133 to accommodate tube expansion during operation, while sealing the exhaust gas inside the floor 30. The drain pipes 133 can be open and shut as by valves 134, such as by the illustrated gate valves 134, ball valves, or other valves known in the art. The valves 134 can be operated so that the drain pipes 133 can carry fluid to a disposal point during times when the OTSG coil 52 may need to be emptied of fluid.

Drain bypass conduits 140, which can be pipes or tubes, connect desired adjacent drains 133. Bypasses 140 allow a relatively small amount of flow to circulate between the pair of drain pipes 133 with which the bypasses 140 are connected. The movement of fluid through the bypasses 140 is stimulated by fluid movement within the drain pipes 133 to thus reduce stagnation of fluid within the separate drain pipes 133, and create a cooling effect on the drain pipes 133. Such cooling can be beneficial for situations in which process conditions and the metallurgy of the drain pipes 133 require that they be cooled during operation.

System hydrodynamics and differing heat absorption of different individual conduits 90 can create destabilization and pressure difference between individual conduits 90. Such a pressure difference causes flow through the equalization intermediate conduits 125 and equalization headers 130 to occur to balance those pressure differences. Such pressure balancing has a stabilizing effect on the flow through the conduits 90.

As the fluid flows downwardly through vertical tube sections 108 into each lower U-bend section 120, the fluid is subject to the forces of gravity and the centrifugal force of the fluid as it turns in the lower U-bend section 120. Water, being of higher density than steam, will be forced to the interior surface of the extrados of the U-bend section 120 by the centrifugal and gravitational forces. Particularly in the case of two-phase flow, it is desirable to redistribute only water flow through the equalization headers 130. The high mass flux of the fluid through each tube row 123 plus the forces on the higher density fluid in the lower U-bend sections 120 ensures that only water is present in the equalization intermediate conduit 125 and equalization header 130 during subcritical operation.

The interior diameter of pipe forming the individual conduits 90 are a function of the specific design details and can for example be about 0.5" in. to about 2". The shape of the arc of the bend in U-bends 120 is preferably of a generally semi-circular shape. The bend centerline radius of a U-bend 120 can be, for example, about 1.5 to about 3.0 centerline conduit diameters. The thickness of the wall of the individual conduits 90 can be based upon material type, diameter, operating temperatures and pressures.

The equalization intermediate conduits 125 are preferably pipe having nominal diameter in the range of about 0.25" to about 1.0". The inside diameter of the equalization conduit conduits 125 is preferably smaller than the inside diameter of the individual conduits 90. The smaller inside diameter of the equalization intermediate conduits 125 relative to the inside diameter of its respective individual tube facilitates only a relatively small amount of flow through the intermediate equalization conduit as compared to the amount of flow through the lower U-bend sections 120, to pressurize the equalization headers 130. In subcritical operation the flow through intermediate conduits 125 would include liquid water, which promotes stability of the system. In a preferred embodiment the inside diameter of an equalization conduit 125 is noticeably smaller than the inside diameter of its respective individual conduit 90. In a preferred embodiment the ratio of the inside diameter of an equalization conduit 125 to the inside diameter of its respective individual conduit 90 is about ⅓ to about ½.

The drains 133 are preferably pipe having a nominal diameter of about 1.5" to about 2". A bellows expansion joint 140 is used with drain pipe 133 to take up expansion during operation while sealing the exhaust gas inside the floor 30. The drain pipes 133 carry fluid to a disposal point during times when the tubes 90 may need to be emptied of fluid. Drain bypasses 144 connect adjacent drains 133 and allow a small amount of flow to circulate through the drain pipes 133 for situations where process conditions and the metallurgy of the drain pipes 133 require that they be cooled during operation.

Figure 7:
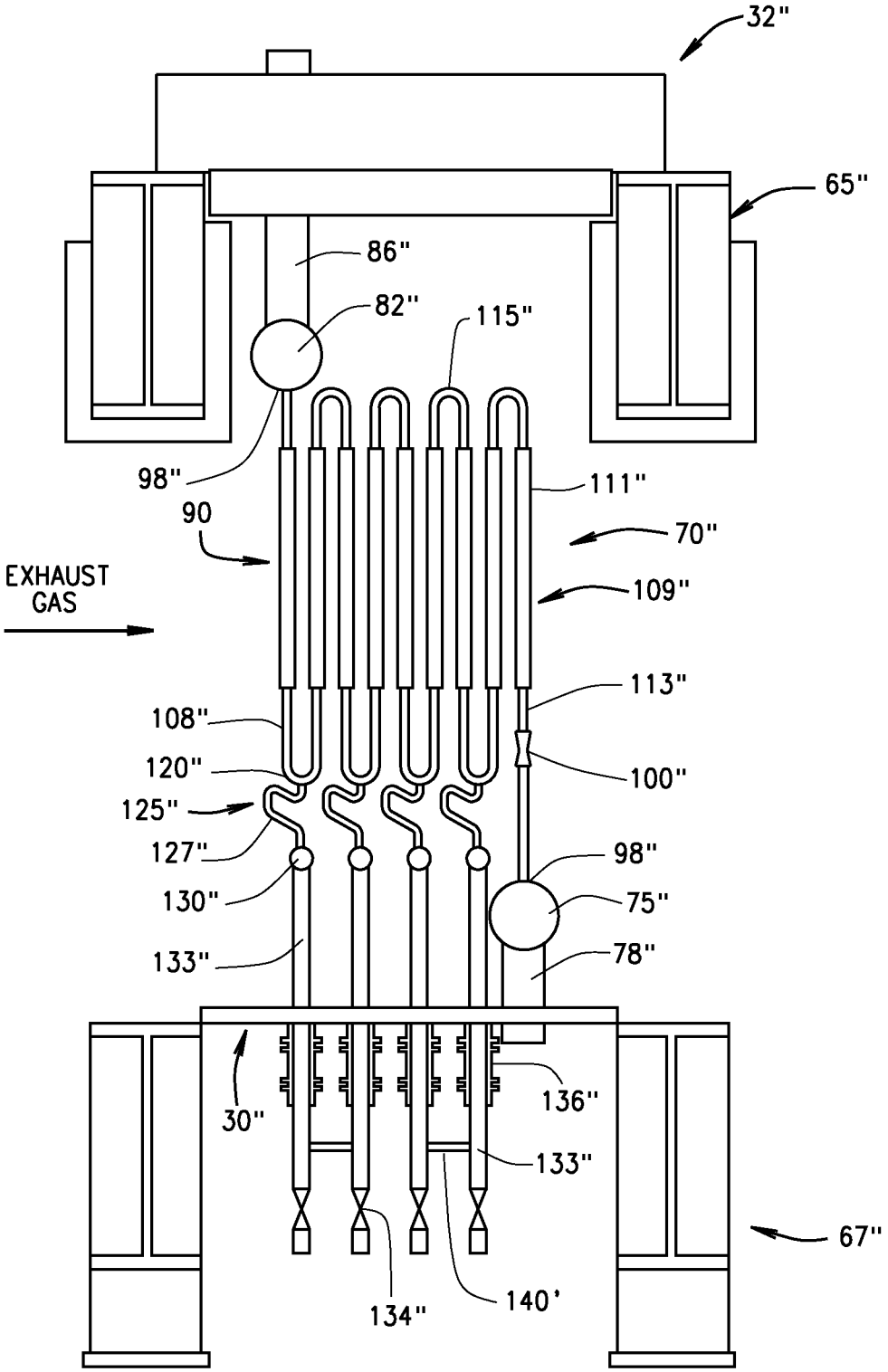
FIG. 7 is an embodiment of the invention wherein the individual intermediate conduits incorporate an expansion loop to address differential tube expansion.

FIG. 7 depicts an embodiment where each equalization intermediate conduit 125" is formed into an expansion loop shaped, or bowed, section 127". It is expected for coils of this type to have temperature variations between adjacent vertical tube sections 108 in the same tube row 123 due to external variations in heat input. Large variations in temperature can cause stress in the connections between individual conduits 90, intermediate conduits 125 and headers 130. The equalization headers 130 effectively anchor the lower U-bend sections 120 and restrict differential growth in adjacent individual conduits 90. The looped or bowed configuration of section 127" allows it to flex during expansion and contraction so that each pair of vertical tube sections 108" connected directly to intermediate conduit 125" can move independently of other adjacent vertical tube sections 108" in their tube rows 123". In FIG. 7 the expansion loop section 127" can comprise many configurations including for example "C", "V", "U" or "L" shape, and can have vertical and horizontal sections not in the same plane. Such configuration can allow independent growth or contraction of each vertical tube section 108-108'". The amount of temperature variation in adjacent conduits 90 will determine if the embodiment of FIG. 7 is employed or not, depending on thermal-mechanical analysis of the fluid flow, geometry and materials used. The expansion loop shaped configuration 127" flexes and bends during operation to thus provide flexibility in adjusting to temperature variations that can exist between different individual conduits 90", to thus reduce and avoid damage or failures from creep stresses and fatigue stresses.

Figure 8:
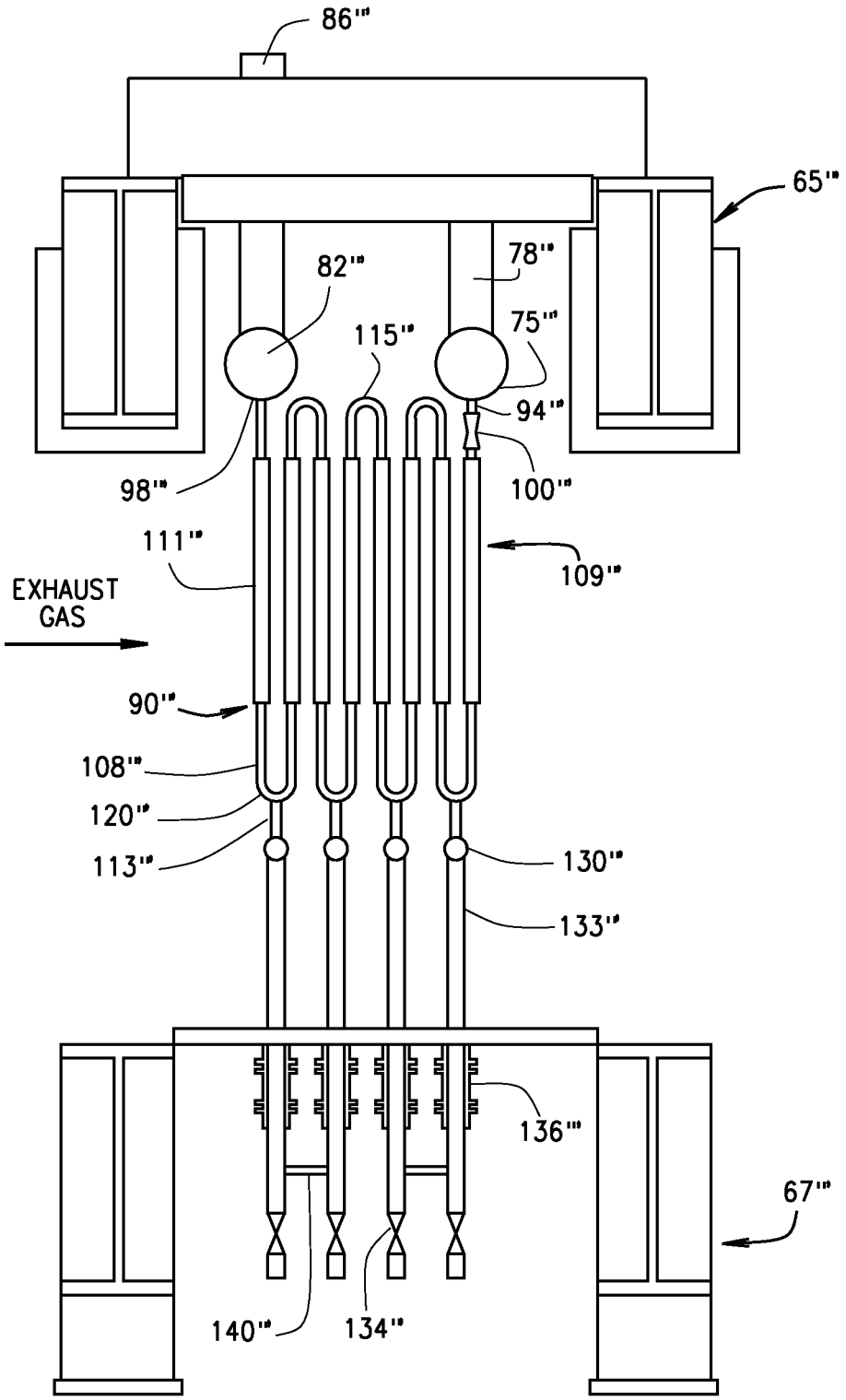
FIG. 8 is an embodiment of the invention showing an alternate inlet location at the top and an even number of tube rows.

FIG. 8 depicts an alternate embodiment where the inlet header 75'" is positioned toward the top of the coil 52'". Fluid moves through the serpentine portions of the coil 52'" in the same manner as heretofore described, but with the first row 123'" starting with fluid flow in the downward direction. In the FIG. 8 embodiment the flow restriction device 100'" is located below the inlet header 100'", and above the middle portion 109'" of the first vertical section 121'".

Preferably, the overall serpentine fluid flow path flows counter current to the exhaust gas. Alternatively, the configuration could be a serpentine flow path flowing co-current to the exhaust gas. In the case of such reversed flow, the locations of the inlet headers 75, 75', 75" and 75'" and outlet headers 82, 82', 82" and 82'" are switched with each other. The location of the first vertical tube section 121, 121', 121" or 121'", rather than being to the far right or farther away from the HRSG inlet, would be to be the farthest upstream of the vertical tube sections closer to the HRSG inlet 25. The repositioning of the inlet headers 75, 75', 75" or 75'" could be above or below such corresponding repositioned first vertical section 121, 121', 121" or 121'". There can also be mixed flow embodiments with both co-current and counter-current sections.

Figure 10:
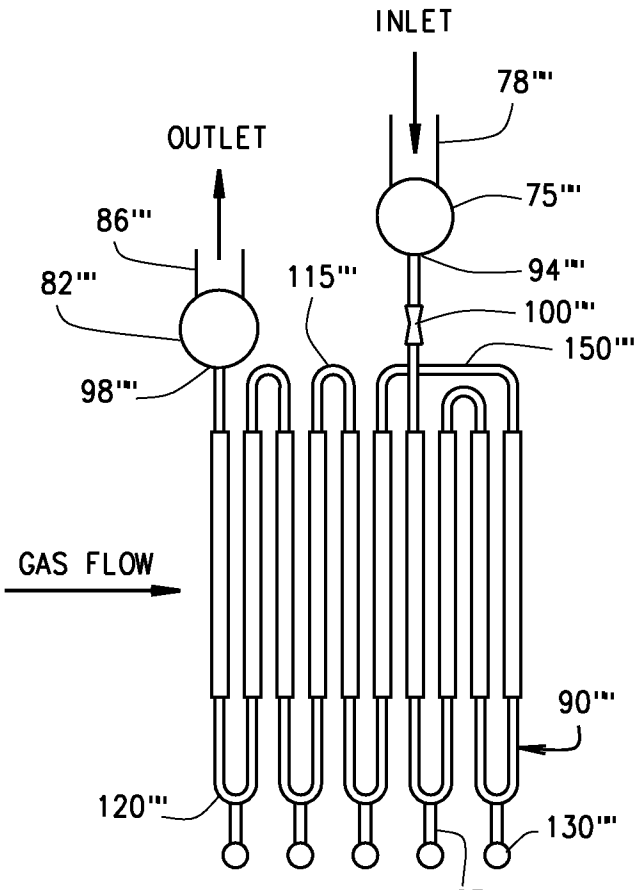
FIG. 10 is an alternate embodiment of the invention showing a mixture of counter current flow and co-current flow, with an inlet header towards the top.
Figure 9:
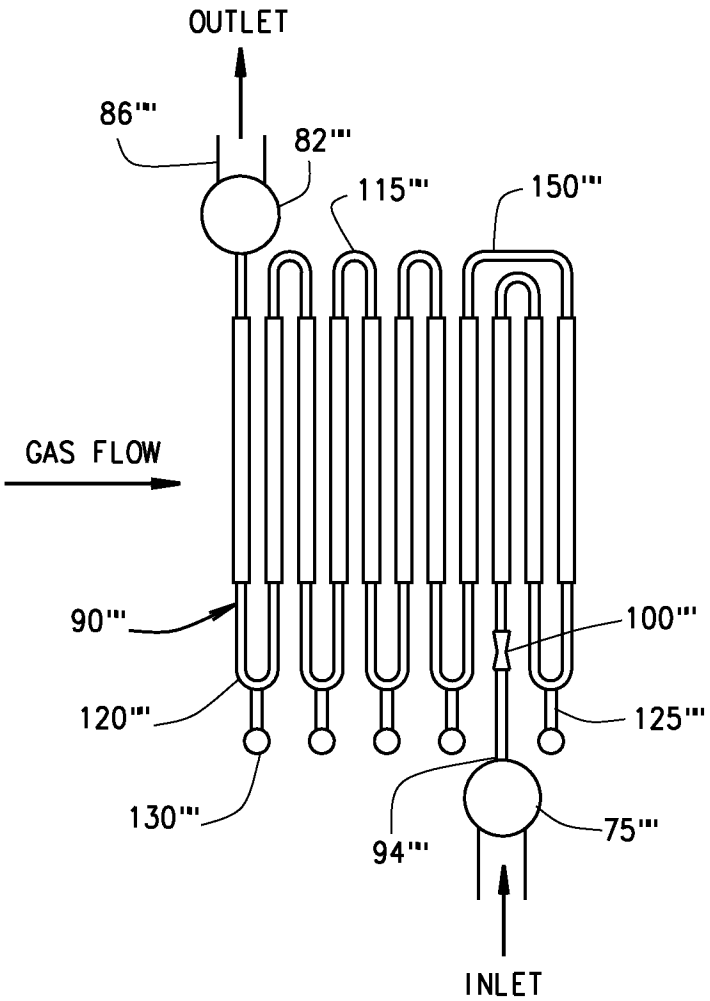
FIG. 9 is an alternate embodiment of the invention showing a mixture of counter current flow and co-current flow, with an inlet header towards the bottom.

Alternatively, there could be a mixture of counter current flow and co-current flow in the same serpentine flow path. FIGS. 9 and 10 show two alternative embodiments featuring such mixed flow. Such mixture can occur regardless of the position of the inlet header being at the bottom or top of the flow path. FIG. 9 shows the inlet header 75"" at the bottom of the flow path, while FIG. 10 shows the inlet header 75""" at the top of the flow path. As a general exemplary description, the first three or four tube rows 113"" (FIG. 9) or 113""" (FIG. 10) can flow co-current to the internal exhaust gas flow before changing direction through a loop back section 150"" (FIG. 9) or 150""" (FIG. 10), respectively, to flow counter current to that flow path. The flow through the individual conduits 90"" or 90""", respectively, terminates into the outlet header 82"" or 82""", respectively. Benefits of this mixed flow path include more efficient phase change in subcritical conditions in the co-current flow path, and then changing to counter current flow to complete the heating of fluid as required.

The number of tube rows 123'" and the relative position of the inlet 78'" and outlet 86'" is a function of the exhaust gas conditions and the amount of heating surface needed to heat the fluid. The invention is not limited by the number of tube rows 123 depicted in the figures, or the relative positions of the inlet 78 and outlet 86. The invention is not limited by the number of individual conduits or serpentine sections in the transverse direction, nor in the number of coils 52 that these serpentine tubes can form and that are placed in the HRSG exhaust path.

In operation, for startup and low load operation the system can be operated at subcritical conditions. During all modes of operation flow entering the inlet header 75 is subcooled so that the water inlet temperature is below the saturation temperature. The system is designed to maintain this requirement by employing economizer-inlet approach temperature control. In order to avoid gravity controlled flow regimes a minimum tube mass flux is desired. That flow preferably is at least about 400 kg/ms2. Lower mass flux may be acceptable in certain specific designs and/or operating modes. Flow stability during startup and low load conditions are particularly important, and preferably should be kept above about 400 kg/ms2. As noted, the inclusion of a flow restriction device and pressure equalization headers serve to stabilize flow and reduce localized temperature and pressure differences in the coil.

For startup and low loads in subcritical operation, an HRSG with an OTSG, such as the OTSG 47 of FIG. 2, can be placed in a flow control mode. The outlet steam/water mixture can be separated in an external separator such as external separator 88 of FIG. 2, where the water can be recycled to the plant condenser, for example, or to another point in the system, e.g., atmospheric blowoff tank, an economizer connection, a dedicated flash tank, or other place such as known in the art. Once sufficient heat is available to the OTSG 47 to produce superheated steam, the flow control is preferably changed to be based upon steam outlet temperature and other parameters. Thereafter, pressure can be increased to supercritical operation.

Changes can be made in the above constructions without departing from the scope of the disclosure. It is intended that all matter contained in the above description or shown in the accompanying drawings shall be interpreted as illustrative and not in a limiting sense.

What is claimed is:

1. A heat recovery steam generator ("HRSG") comprising:

a casing having an inlet and an outlet and an internal exhaust flow path there between for gas flow upstream from the inlet toward the outlet downstream therefrom;

a high pressure economizer located within the casing downstream from the inlet;

a once through steam generator ("OTSG") system located upstream of the high pressure economizer, the OTSG system comprising:

a fluid inlet header conduit which is in fluid flow connection with the high pressure economizer;

a fluid outlet header conduit;

a group of a plurality of serpentine tubes comprised of individual serpentine tube conduits, the individual serpentine tube conduits having an inlet end in fluid flow connection with the inlet header conduit, and an outlet end in fluid flow connection with the outlet header conduit;

the individual serpentine tube conduits having a plurality of generally linear vertical sections, a plurality of curved upper sections which are in fluid flow connection with the upper portions of a pair of corresponding vertical sections, and a plurality of curved lower sections which are in fluid flow connection with the lower portions of a pair of corresponding vertical sections;

a plurality of intermediate equalization conduits each of which has an inlet end and an outlet end, each intermediate equalization conduit being associated with a corresponding lower curved section of an individual serpentine tube conduit, the first equalization conduit inlet ends being in fluid flow connection with respective lower curved sections of the serpentine sections of individual tube conduits; and an equalization header conduit, with the outlet ends of the intermediate conduits being in fluid flow connection with the equalization header conduit.

2. The HRSG of claim 1 wherein the curved lower section of the serpentine tube conduits has a U-bend configuration, the intermediate conduits are generally vertically oriented relative to the HRSG, and the inlet ends of the intermediate conduits are connected to their respective U-bend sections at approximately the bottom of the U-bends.

3. The HRSG of claim 2 wherein the individual serpentine tubes have an inside diameter and the intermediate conduits have an inside diameter, wherein the ratio of the inside diameter of a plurality of the intermediate conduits to the inside diameter of the individual serpentine tubes is from about ⅓ to about ½.

4. The HRSG of claim 2, further comprising a drain conduit having an inlet end in fluid flow connection with the equalization header conduit, the drain conduit having a portion that extends in a downward direction relative to the equalization header conduit, and a valve positioned with the drain conduit and configured to be placed in a first position to block flow through the drain conduit, and to be placed in a second position to allow flow through the drain conduit.

5. The HRSG of claim 4 wherein a portion of the drain conduit is oriented vertically relative to the HRSG.

6. The HRSG of claim 4 further comprising a plurality of drain conduits and a plurality of header equalization conduits, and a drain bypass conduit in fluid flow connection with a pair of drain conduits.

7. The HRSG of claim 6 wherein the drain bypass conduit is in fluid flow connection with adjacent drain conduits.

8. The HRSG of claim 2 wherein the plurality of generally linear vertical sections of individual serpentine tube conduits are arranged with the vertical sections of different individual serpentine tubes aligned transversely relative to the HRSG internal exhaust flow path, with collective groups of vertical serpentine sections forming an aligned transverse row of vertical sections.

9. The HRSG of claim 4 comprising a flow restriction device located in the fluid flow path of an individual serpentine conduit, the flow restriction device having an inner diameter that is less than that of the inside diameter of its respective individual serpentine conduit.

10. The HRSG of claim 4 comprising each individual tube conduit having a vertical section positioned to be the first vertical section in fluid flow connection with the inlet end of the individual serpentine tube conduit, and further comprising a flow restriction device positioned in the first vertical section to be in fluid flow connection therewith, the flow restriction device having an inner diameter that is less than that of the inside diameter of its respective individual serpentine conduit.

11. The HRSG of claim 9 comprising the first vertical tube section having a middle portion, and the flow restriction device being located between the inlet end of the individual tube conduit and the middle portion of the first vertical section.

12. The HRSG of claim 1 wherein the fluid inlet header conduit is located downstream from the fluid outlet conduit in the HRSG internal exhaust flow path.

13. The HRSG of claim 1 wherein the fluid inlet header conduit is located upstream from the fluid outlet conduit in the HRSG internal exhaust flow path.

14. The HRSG of claim 1 wherein the vertical sections in individual serpentine tubes are aligned in a generally longitudinal direction and positioned so that they are sequentially downstream of a preceding vertical section, with one of the vertical sections being located the farthest upstream of the vertical tube sections and another vertical section being the one located the farthest downstream of the vertical tube sections, with the inlet header being connected to be in flow connection with an individual serpentine tube at a location between the said farthest upstream and downstream tube sections, the individual serpentine tube comprising a loop back conduit section, configured so that fluid can flow in a first downstream co-current direction through the serpentine conduit and thence flow through the loop back section to be directed in a second upstream counter-current direction through the serpentine conduit to flow into the outlet header.

15. The HRSG of claim 1 comprising individual tubes, each having a first vertical section, and wherein the fluid inlet header conduit is located to be beneath the first vertical section for fluid flow generally upwardly toward the first vertical section.

16. The HRSG of claim 1 comprising individual tubes which each have a first vertical section, and wherein the fluid inlet header conduit is located to be above the first vertical section for fluid flow generally downwardly toward the first vertical section.

17. The HRSG of claim 1 comprising the arrangement of the vertical sections in an individual tube being staggered in a longitudinal direction in the exhaust flow path in an alternate offset pattern, with a vertical section longitudinally downstream from an adjacent vertical section being longitudinally offset therefrom in an alternating pattern so that the vertical sections are not in longitudinal alignment.

18. The HRSG of claim 1 comprising the pattern of the arrangement of the vertical sections in an individual tube is offset so that a first group of the vertical sections in the individual tube are in longitudinal alignment with one another, and a second group of the vertical sections are in longitudinal alignment with one another, with the first and second groups not in longitudinal alignment with each other.

19. The HRSG of claim 1 comprising the vertical sections in an individual tube being longitudinally aligned with one another in a longitudinal direction in the exhaust flow path.

20. The HRSG of claim 1 comprising the intermediate equalization conduits comprising an offset expansion portion that bends to extend laterally and downwardly relative to the inlet connection of the intermediate conduit to its respective individual return bend.

21. The HRSG of claim 20 comprising the offset portion that bends to extend laterally and downwardly having a generally loop shaped configuration.

22. The HRSG of claim 21 comprising the loop shaped offset portion of the intermediate conduit having a configuration selected from the group consisting of generally "C", "V", "U", and "L" shaped configurations.

23. A method of operating a heat recovery steam generator ("HRSG") having a once through steam generator ("OTSG") system having within the internal longitudinal exhaust flow path of the HRSG a plurality of serpentine conduits having lower and upper curved sections in fluid flow connection with generally vertical linear sections, the serpentine conduits extending generally longitudinally in alignment with internal exhaust gas flow through the HRSG, comprising:

high pressure fluid flowing into an inlet header conduit, thence flowing through the plurality of serpentine conduits;

separating fluid flow from the lower curved serpentine sections from fluid flowing toward the generally vertical serpentine sections;

flowing of the separated fluid from the lower curved serpentine sections through first conduits in flow connection with the lower curved serpentine sections;

balancing the pressure and temperature difference among the plurality of serpentine conduits through a second fluid header conduit that is in fluid flow connection with the first conduits; and discharging fluid from the serpentine conduits into an outlet header conduit.

24. The method of claim 23 further comprising fluid flowing into the inlet header from a high pressure economizer located within the HRSG internal exhaust flow path.

25. The method of claim 23 further comprising fluid flowing through the lower serpentine sections in a generally U-shaped direction, and separation of flow of liquid from flow of fluid occurring at the approximate bottom of the U-shaped flow path.

26. The method of claim 23 further comprising the fluid flowing through the first conduit comprising liquid.

27. The method of claim 23 further comprising the fluid flowing through the first conduit flowing generally downwardly from the lower serpentine sections into the second conduit.

28. The method of claim 23 further comprising restricting the flow of fluid through a section of the serpentine conduits to decrease the fluid pressure within the serpentine conduit.

29. The method of claim 28 further comprising restricting the flow of fluid through a section of the serpentine conduits to force fluid distribution among a plurality of serpentine conduits.

30. The method of claim 23 further comprising the step of draining liquid from the second conduit.

31. The method of claim 30 further comprising draining of liquid through drain conduits, a bypass conduit in fluid flow connection with at least two drain conduits, and fluid flow through the bypass conduit between the at least two interconnected drain conduits.

32. The method of claim 30 further comprising nonlinear flowing of fluid through the first conduits to the second conduits.

33. The method of claim 23 further comprising fluid flow through individual serpentine conduits in longitudinally staggered directions of flow as the fluid moves through the serpentine conduits in the HRSG internal exhaust gas flow path.

34. The method of claim 23 further comprising fluid flow through individual serpentine conduits in an approximately straight longitudinally aligned flow path as the fluid moves through the HRSG internal exhaust gas flow path.

35. The method of claim 23 further comprising fluid flow through individual serpentine conduits having a mass flux at least above about 400 $kg/ms^2$.

36. The method of claim 23 further comprising fluid flow through individual serpentine conduits at supercritical pressures.

37. The method of claim 23 further comprising fluid flow through individual serpentine conduits in a first downstream co-current direction through the serpentine conduit and thence to be directed in a second upstream counter-current direction through the serpentine conduit to flow into the outlet header.

* * * * *